US010167611B2

(12) United States Patent
Kondo et al.

(10) Patent No.: US 10,167,611 B2
(45) Date of Patent: Jan. 1, 2019

(54) HYDRAULIC EXCAVATOR DRIVE SYSTEM

(71) Applicant: KAWASAKI JUKOGYO KABUSHIKI KAISHA, Kobe-shi, Hyogo (JP)

(72) Inventors: Akihiro Kondo, Nishinomiya (JP); Makoto Ito, Kobe (JP); Kazuto Fujiyama, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 158 days.

(21) Appl. No.: 15/129,215

(22) PCT Filed: Feb. 16, 2015

(86) PCT No.: PCT/JP2015/000693
§ 371 (c)(1),
(2) Date: Sep. 26, 2016

(87) PCT Pub. No.: WO2015/145946
PCT Pub. Date: Oct. 1, 2015

(65) Prior Publication Data

US 2017/0107694 A1 Apr. 20, 2017

(30) Foreign Application Priority Data

Mar. 24, 2014 (JP) ..... 2014-060157

(51) Int. Cl.
*E02F 9/22* (2006.01)
*F15B 11/028* (2006.01)
(Continued)

(52) U.S. Cl.
CPC ..... *E02F 9/2203* (2013.01); *E02F 3/425* (2013.01); *E02F 9/2207* (2013.01);
(Continued)

(58) Field of Classification Search
CPC ..... F15B 11/028; F15B 2211/761; F15B 2211/45; F15B 2211/46; F15B 2211/5159; F15B 2211/30565
See application file for complete search history.

(56) References Cited

U.S. PATENT DOCUMENTS 7,127,888 B2 * 10/2006 Kajita ..... E02F 9/2228 60/424
9,169,620 B2 * 10/2015 Gabibulayev ..... F15B 11/044

FOREIGN PATENT DOCUMENTS

JP H11-101183 A 4/1999
JP 2003028101 A * 1/2003
(Continued)

OTHER PUBLICATIONS

JP 2003028101 A machine translation to English from espacenet. 2003.*

(Continued)

*Primary Examiner* — F. Daniel Lopez
*Assistant Examiner* — Michael Quandt
(74) *Attorney, Agent, or Firm* — Oliff PLC

(57) ABSTRACT

A hydraulic excavator drive system includes: a cylinder that drives a moving part that is an arm or a bucket. Hydraulic oil is supplied from a hydraulic pump to the cylinder via a control valve. A bypass line branches off from a rod-side supply/discharge line. The bypass line is blocked and opened by a restrictor. The restrictor is controlled by a controller such that, when the hydraulic oil is supplied to the cylinder through a head-side supply/discharge line, the restrictor blocks the bypass line if a pressure detected by a load detector is lower than a predetermined value, and opens the bypass line if the pressure detected by the load detector is higher than or equal to the predetermined value.

6 Claims, 8 Drawing Sheets

(51) Int. Cl.

| | |
|---|---|
| ***E02F 3/42*** | (2006.01) |
| ***F15B 11/08*** | (2006.01) |
| ***F15B 13/04*** | (2006.01) |
| *E02F 3/32* | (2006.01) |

(52) U.S. Cl.

CPC ..... *E02F 9/2225* (2013.01); *E02F 9/2282* (2013.01); *E02F 9/2285* (2013.01); *E02F 9/2292* (2013.01); *E02F 9/2296* (2013.01); *F15B 11/028* (2013.01); *F15B 11/08* (2013.01); *F15B 13/0417* (2013.01); *E02F 3/32* (2013.01); *F15B 2211/45* (2013.01); *F15B 2211/46* (2013.01); *F15B 2211/50518* (2013.01); *F15B 2211/5159* (2013.01); *F15B 2211/526* (2013.01); *F15B 2211/7051* (2013.01); *F15B 2211/761* (2013.01)

(56) References Cited

FOREIGN PATENT DOCUMENTS

| | | | |
|---|---|---|---|
| JP | 2005-140153 | A | 6/2005 |
| JP | 2005-325911 | A | 11/2005 |

OTHER PUBLICATIONS

May 19, 2015 Written Opinion issued in International Patent Application No. PCT/JP2015/000693.

Jun. 13, 2017 Office Action issued in Chinese Patent Application No. 201580008050.7.

* cited by examiner

HYDRAULIC EXCAVATOR DRIVE SYSTEM

TECHNICAL FIELD

The present invention relates to a hydraulic excavator drive system.

BACKGROUND ART

Generally speaking, a hydraulic excavator includes: a boom that is raised and lowered relative to a turning unit; an arm swingably coupled to the distal end of the boom; and a bucket swingably coupled to the distal end of the arm. A drive system installed in such a hydraulic excavator includes, for example, a boom cylinder driving the boom, an arm cylinder driving the arm, and a bucket cylinder driving the bucket. These hydraulic actuators are supplied with hydraulic oil from hydraulic pumps via control valves (see Patent Literature 1, for example).

CITATION LIST

Patent Literature

PTL 1: Japanese Laid-Open Patent Application Publication No. H11-101183

SUMMARY OF INVENTION

Technical Problem

Each of the arm and the bucket is driven such that its center of gravity crosses a vertical line that passes through its swinging center. Therefore, in the case of performing an arm crowding operation to bring the arm close to an operator cab, the weight of the arm is exerted in such a direction as to accelerate the swinging of the arm, or in such a direction as to decelerate the swinging of the arm, depending on the position of the arm. Similarly, in the case of performing a bucket-in operation to bring the bucket close to the operator cab, the weight of the bucket is exerted in such a direction as to accelerate the swinging of the bucket, or in such a direction as to decelerate the swinging of the bucket, depending on the position of the bucket.

In the case of performing an arm crowding operation or bucket-in operation, hydraulic oil returns to the tank from the rod side of the arm cylinder or bucket cylinder via a control valve. Here, if the opening area of an arm control valve or bucket control valve for returning the hydraulic oil to the tank at the time of expanding the cylinder is large, then in the case of moving the arm or bucket in the air, until the center of gravity of the arm or bucket reaches directly below its swinging center, there is a risk that cavitation occurs at the head side of the cylinder due to the above-described influence of the weight of the arm or bucket. Also, in the case of further continuing operating the arm or bucket, after the center of gravity of the arm or bucket has reached directly below its swinging center, there is a risk that the swinging of the arm or bucket temporarily stops until the head-side pressure of the cylinder becomes sufficiently high.

As one measure for preventing these problems, it is conceivable to perform meter-out control of the control valve at the time of expanding the arm cylinder or bucket cylinder. Specifically, the opening area of the control valve for returning the hydraulic oil to the tank at the time of expanding the cylinder is reduced. However, in this case, particularly at the time of performing excavation, the reduced opening area causes resistance, and thereby the discharge pressure of the hydraulic pump increases more than necessary, which results in wasteful energy consumption.

In view of the above, an object of the present invention is to provide a hydraulic excavator drive system capable of suppressing wasteful energy consumption while preventing the occurrence of cavitation at the head side of the arm cylinder or bucket cylinder and preventing temporary stopping of the swinging of the arm or bucket.

Solution to Problem

In order to solve the above-described problems, a hydraulic excavator drive system according to the present invention includes: a cylinder that drives a moving part that is an arm or a bucket; a control valve connected to the cylinder by a head-side supply/discharge line and a rod-side supply/discharge line; a hydraulic pump that supplies hydraulic oil to the cylinder via the control valve; a load detector that detects a pressure of the hydraulic oil discharged from the hydraulic pump or a pressure of the hydraulic oil supplied to the cylinder through the head-side supply/discharge line; a bypass line that branches off from the rod-side supply/discharge line and connects to a tank; a restrictor that blocks and opens the bypass line; and a controller that controls the restrictor such that, when the hydraulic oil is supplied to the cylinder through the head-side supply/discharge line, the restrictor blocks the bypass line if the pressure detected by the load detector is lower than a predetermined value, and opens the bypass line if the pressure detected by the load detector is higher than or equal to the predetermined value.

According to the above configuration, at the time of expanding an arm cylinder or bucket cylinder (i.e., at the time of performing an arm crowding operation or bucket-in operation), the bypass line is blocked if the head-side pressure of the cylinder is low (e.g., a case where the arm or bucket is moved in the air). Accordingly, by setting the opening area of an arm control valve or bucket control valve for returning the hydraulic oil to the tank at the time of expanding the cylinder to be small, cavitation can be prevented from occurring at the head side of the arm cylinder or bucket cylinder, and also, temporary stopping of the swinging of the arm or bucket can be prevented. On the other hand, if the head-side pressure of the cylinder is high (e.g., when excavation is being performed), the bypass line is opened. Accordingly, even though the opening area of the control valve for returning the hydraulic oil to the tank at the time of expanding the cylinder is set to be small, large part of the hydraulic oil at the rod side of the cylinder returns to the tank through the bypass line at the time of expanding the cylinder. As a result, the discharge pressure of the hydraulic pump will not increase more than necessary, which makes it possible to suppress wasteful energy consumption.

For example, the restrictor may include: a position adjusting valve that is provided on the bypass line and that increases its opening area in accordance with an increase in a pilot pressure; and a solenoid proportional valve that outputs the pilot pressure to the position adjusting valve.

The above hydraulic excavator drive system may further include: an operation valve that outputs a pilot pressure to the control valve; and an operation detector that detects the pilot pressure outputted from the operation valve. The controller may feed the solenoid proportional valve with an electric current proportional to the pilot pressure detected by the operation detector if the pressure detected by the load detector is higher than or equal to the predetermined value.

According to this configuration, the opening area of the position adjusting valve can be properly controlled in accordance with an operating amount of the operation valve.

The above hydraulic excavator drive system may further include a position detector that detects a position of the moving part. The controller may: control the restrictor such that the restrictor blocks or opens the bypass line in accordance with the pressure detected by the load detector if the controller determines, based on a detection result from the position detector, that a center of gravity of the moving part is distant from an operator cab than a vertical line that passes through a swinging center of the moving part; and control the restrictor such that the restrictor opens the bypass line regardless of the pressure detected by the load detector if the controller determines, based on the detection result from the position detector, that the center of gravity of the moving part is closer to the operator cab than the vertical line that passes through the swinging center of the moving part. According to this configuration, if the center of gravity of the moving part, which is an arm or bucket, is closer to the operator cab than the vertical line, i.e., in a case where the weight of the moving part is exerted on the moving part itself in a direction reverse to the swinging direction, the bypass line is opened. That is, blocking of the bypass line can be limitedly performed only in a case where the weight of the moving part is exerted on the moving part itself in the swinging direction. This makes it possible to make the most of the bypass line.

The moving part may be an arm, and the cylinder may be an arm cylinder. The above hydraulic excavator drive system may further include an excavation detector that detects a head-side pressure of a bucket cylinder. In a case where the controller determines, based on a detection result from the position detector, that the center of gravity of the arm is closer to the operator cab than the vertical line that passes through the swinging center of the arm, if the pressure detected by the excavation detector is higher than or equal to a threshold, the controller may feed the solenoid proportional valve with an electric current that is set based on a current/pilot pressure relation line that is the same as a current/pilot pressure relation line based on which the electric current fed to the solenoid proportional valve when the pressure detected by the load detector is higher than or equal to the predetermined value is set, and if the pressure detected by the excavation detector is lower than the threshold, the controller may feed the solenoid proportional valve with an electric current that is set based on a current/pilot pressure relation line whose slope is less than that of the current/pilot pressure relation line based on which the electric current fed to the solenoid proportional valve when the pressure detected by the load detector is higher than or equal to the predetermined value is set. According to this configuration, the swinging of the arm will not become too fast, and the discharge pressure of the hydraulic pump will not increase more than necessary. This makes it possible to suppress wasteful energy consumption.

The position adjusting valve may be connected to the head-side supply/discharge line by a relay line, and may be configured to bring the relay line into communication with the tank through the bypass line when the hydraulic oil is supplied to the cylinder through the rod-side supply/discharge line. According to this configuration, at the time of performing an arm-pushing operation or bucket-out operation, part of the hydraulic oil flowing out of the head side of the cylinder can be returned to the tank without flowing through the arm control valve or bucket control valve. That is, the back pressure at the time of contracting the cylinder can be successfully reduced by effectively utilizing the position adjusting valve and the bypass line.

The position adjusting valve may be disposed on a bleed line extending from the hydraulic pump. According to this configuration, the position adjusting valve can be incorporated into a multi control valve unit together with the control valve.

Advantageous Effects of Invention

The present invention makes it possible to suppress wasteful energy consumption while preventing the occurrence of cavitation at the head side of the arm cylinder or bucket cylinder and preventing temporary stopping of the swinging of the arm or bucket.

DESCRIPTION OF EMBODIMENTS

Embodiment 1

Figure 1:
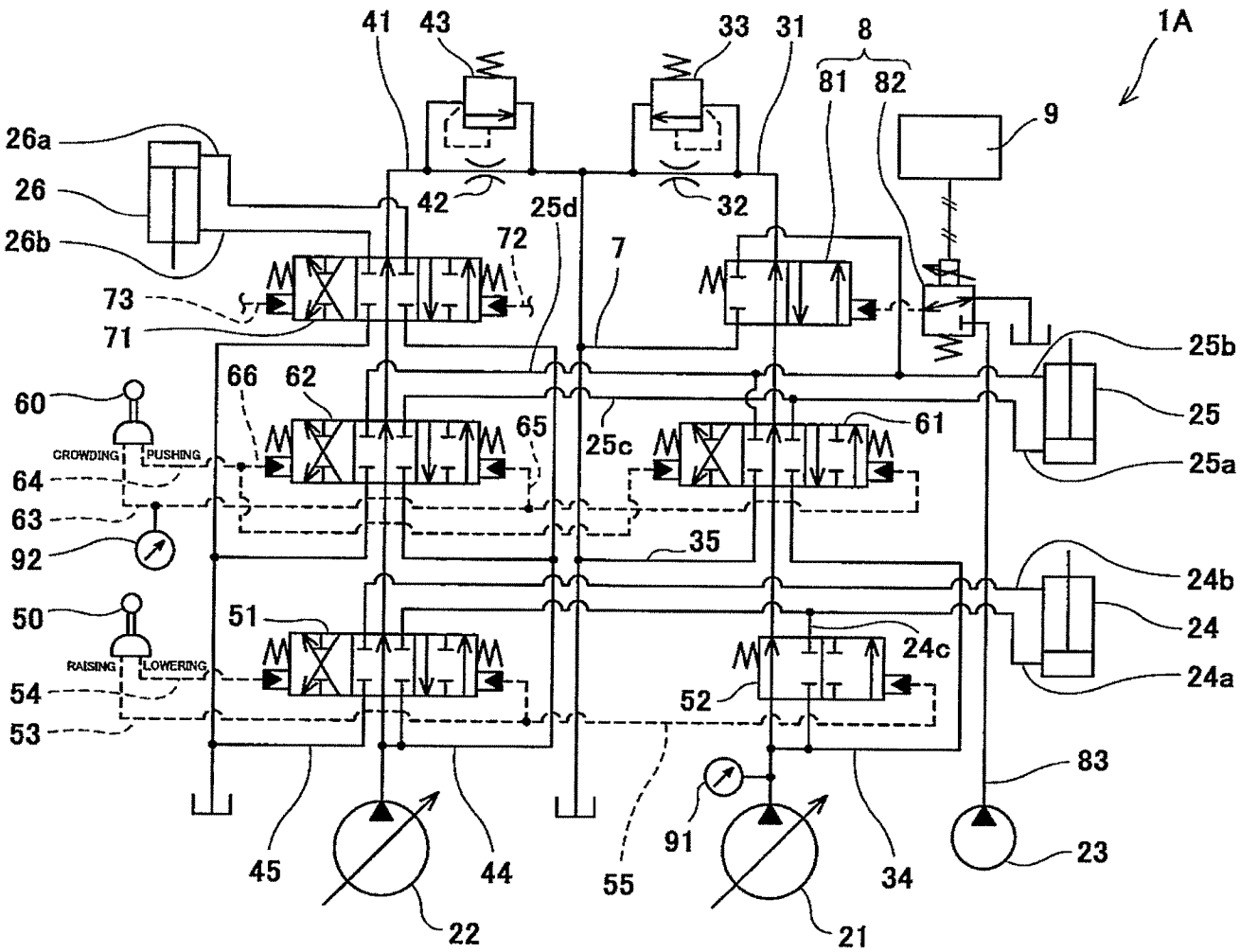
FIG. 1 is a hydraulic circuit diagram of a hydraulic excavator drive system according to Embodiment 1 of the present invention.
Figure 2:
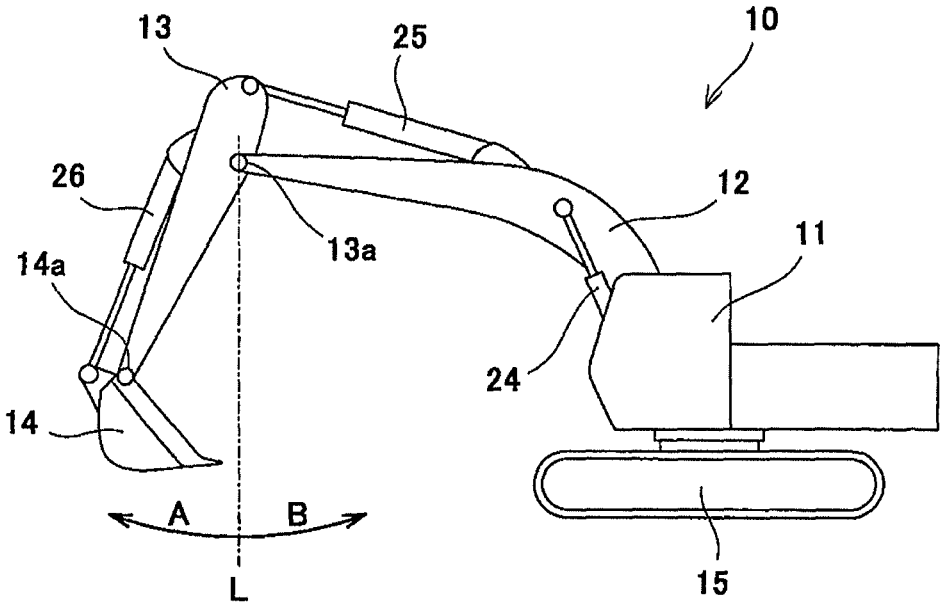
FIG. 2 is a side view of a hydraulic excavator.

FIG. 1 shows a hydraulic excavator drive system 1A according to Embodiment 1 of the present invention, and FIG. 2 shows a hydraulic excavator 10 in which the drive system 1A is installed.

The hydraulic excavator 10 shown in FIG. 2 includes a running unit 15 and a turning unit 11. The hydraulic excavator 10 further includes: a boom 12, which is raised and lowered relative to the turning unit 11; an arm 13 swingably coupled to the distal end of the boom 12; and a bucket 14 swingably coupled to the distal end of the arm 13.

As shown in FIG. 1, the drive system 1A includes, as hydraulic actuators, a pair of right and left running motors and a turning motor (which are not shown), a boom cylinder 24, an arm cylinder 25, and a bucket cylinder 26. The boom cylinder 24 drives the boom 12. The arm cylinder 25 drives the arm 13. The bucket cylinder 26 drives the bucket 14.

The drive system 1A further includes a first hydraulic pump 21 and a second hydraulic pump 22, which supply hydraulic oil to the aforementioned hydraulic actuators. The boom cylinder 24 is supplied with the hydraulic oil from the second hydraulic pump 22 via a boom first control valve 51, and is supplied with the hydraulic oil from the first hydraulic pump 21 via a boom second control valve 52. The arm cylinder 25 is supplied with the hydraulic oil from the first hydraulic pump 21 via an arm first control valve 61, and is supplied with the hydraulic oil from the second hydraulic pump 22 via an arm second control valve 62. The bucket cylinder 26 is supplied with the hydraulic oil from the second hydraulic pump 22 via a bucket control valve 71. The other control valves intended for the turning motor and the running motors are not shown in FIG. 1.

To be more specific, a first bleed line 31 extends from the first hydraulic pump 21 to a tank, and a second bleed line 41 extends from the second hydraulic pump 22 to the tank. The boom second control valve 52 and the arm first control valve 61 are disposed in series on the first bleed line 31. The boom first control valve 51, the arm second control valve 62, and the bucket control valve 71 are disposed in series on the second bleed line 41. It should be noted that the aforementioned control valve for the turning motor, which is not shown, is disposed on the first bleed line 31. Also, the aforementioned control valves for the running motors, which are not shown, are disposed on the first bleed line 31 and the second bleed line 41.

Among the above control valves, the boom second control valve 52 is a two-position valve, while the other control valves are three-position valves. The boom second control valve 52 is dedicated for a boom raising operation.

A parallel line 34 branches off from the first bleed line 31, and the hydraulic oil discharged from the first hydraulic pump 21 is led to all the control valves on the first bleed line 31 through the parallel line 34. Similarly, a parallel line 44 branches off from the second bleed line 41. The hydraulic oil discharged from the second hydraulic pump 22 is led to all the control valves on the second bleed line 41 through the parallel line 44. The control valves on the first bleed line 31 except for the boom second control valve 52 are connected to the tank by a tank line 35. Meanwhile, all the control valves on the second bleed line 41 are connected to the tank by a tank line 45.

All the control valves disposed on the first bleed line 31 and the second bleed line 41 are open center valves. That is, when all the control valves on the bleed line (31 or 41) are at their neutral positions, the flow of the hydraulic oil in the bleed line is not restricted by the control valves, and if any of the control valves moves and shifts from its neutral position, the flow of the hydraulic oil in the bleed line is restricted by the control valve.

In the present embodiment, the discharge flow rate of the first hydraulic pump 21 and the discharge flow rate of the second hydraulic pump 22 are controlled by a negative control method. Specifically, the first bleed line 31 is provided with a throttle 32, which is positioned downstream of all the control valves on the first bleed line 31. A relief valve 33 is disposed on a line that bypasses the throttle 32. Similarly, the second bleed line 41 is provided with a throttle 42, which is positioned downstream of all the control valves on the second bleed line 41. A relief valve 43 is disposed on a line that bypasses the throttle 42.

The first hydraulic pump 21 and the second hydraulic pump 22 are driven by an engine that is not shown. Each of the first hydraulic pump 21 and the second hydraulic pump 22 is a variable displacement pump that discharges the hydraulic oil at a flow rate corresponding to the tilting angle of the pump. The tilting angles of the first hydraulic pump 21 and the second hydraulic pump 22 are adjusted by respective regulators that are not shown. A negative control pressure, which is the pressure at the upstream side of the throttle (32 or 42) on the bleed line (31 or 41), is led to each regulator.

The boom first control valve 51 is connected to the boom cylinder 24 by a boom raising supply line 24*a* and a boom lowering supply line 24*b*. The boom second control valve 52 is connected to the boom raising supply line 24*a* by an auxiliary supply line 24*c*.

Pilot ports of the boom first control valve 51 are connected to a boom operation valve 50 by a boom raising pilot line 53 and a boom lowering pilot line 54. The boom operation valve 50 includes an operating lever, and outputs a pilot pressure whose magnitude corresponds to an operating amount of the operating lever to the boom first control valve 51. A pilot port of the boom second control valve 52 is connected to the boom raising pilot line 53 by an auxiliary pilot line 55.

The arm first control valve 61 is connected to the arm cylinder 25 by an arm crowding supply line 25*a* and an arm pushing supply line 25*b*. The arm second control valve 62 is connected to the arm crowding supply line 25*a* by an auxiliary supply line 25*c*, and is connected to the arm pushing supply line 25*b* by an auxiliary supply line 25*d*.

Pilot ports of the arm first control valve 61 are connected to an arm operation valve 60 by an arm crowding pilot line 63 and an arm pushing pilot line 64. The arm operation valve 60 includes an operating lever, and outputs a pilot pressure whose magnitude corresponds to an operating amount of the operating lever to the arm first control valve 61. Pilot ports of the arm second control valve 62 are connected to the arm crowding pilot line 63 by an auxiliary pilot line 65 and the arm pushing pilot line 64 by an auxiliary pilot line 66.

The bucket control valve 71 is connected to the bucket cylinder 26 by a bucket-in supply line 26*a* and a bucket-out supply line 26*b*. Pilot ports of the bucket control valve 71 are connected to a bucket operation valve (not shown) by a bucket-in pilot line 72 and a bucket-out pilot line 73. The bucket operation valve includes an operating lever, and outputs a pilot pressure whose magnitude corresponds to an operating amount of the operating lever to the bucket control valve 71.

The present embodiment shows an example in which the present invention is applied to meter-out control at the time of expanding the arm cylinder 25. Specifically, the moving part of the present invention is the arm 13; the head-side supply/discharge line of the present invention corresponds to the arm crowding supply line 25*a*; and the rod-side supply/discharge line of the present invention corresponds to the arm pushing supply line 25*b*.

A bypass line 7 branches off from the arm pushing supply line 25*b*. The bypass line 7 is connected to the tank. The bypass line 7 is blocked and opened by a restrictor 8. The restrictor 8 is controlled by a controller 9.

For the control of the restrictor 8, in the present embodiment, a load detector 91 is provided upstream of all the control valves on the first bleed line 31, and an operation detector 92 is provided on the arm crowding pilot line 63. The load detector 91 serves to detect the pressure of the hydraulic oil discharged from the first hydraulic pump 21. The operation detector 92 serves to detect a pilot pressure that is outputted from the arm operation valve 60 when an arm crowding operation is performed (i.e., when the hydraulic oil is supplied to the arm cylinder 25 through the arm crowding supply line 25*a*). For example, pressure sensors are used as the load detector 91 and the operation detector 92.

In the present embodiment, the restrictor 8 includes: a pilot-type position adjusting valve 81 provided on the bypass line 7; and a solenoid proportional valve 82, which outputs a pilot pressure to the position adjusting valve 81. The position adjusting valve 81 is configured to increase its opening area in accordance with an increase in the pilot pressure. While no pilot pressure is being outputted from the solenoid proportional valve 82, the position adjusting valve 81 blocks the bypass line 7. When the solenoid proportional valve 82 outputs a pilot pressure, the position adjusting valve 81 opens the bypass line 7 with an opening area corresponding to the pilot pressure.

In the present embodiment, the position adjusting valve 81 is a four-port valve disposed on the first bleed line 31. The position adjusting valve 81 is configured not to restrict the flow of the hydraulic oil in the first bleed line 31 regardless of whether the position adjusting valve 81 does not move (i.e., the solenoid proportional valve 82 does not output a pilot pressure) or the position adjusting valve 81 has moved (i.e., the solenoid proportional valve 82 has outputted a pilot pressure). It should be noted that the position adjusting valve 81 may be a two-port valve that is not disposed on the first bleed line 31.

The solenoid proportional valve 82 is connected to an auxiliary pump 23 by a primary pressure line 83. The auxiliary pump 23 is driven by the aforementioned engine, which is not shown. When the solenoid proportional valve 82 is fed with an electric current from the controller 9, the solenoid proportional valve 82 outputs a pilot pressure (secondary pressure) whose magnitude corresponds to the electric current to the position adjusting valve 81. When the solenoid proportional valve 82 is fed with no electric current from the controller 9, the solenoid proportional valve 82 outputs no pilot pressure to the position adjusting valve 81.

The controller 9 feeds an electric current to the solenoid proportional valve 82 only when an arm crowding operation is performed. At the time of performing an arm crowding operation, the controller 9 determines whether or not to feed an electric current to the solenoid proportional valve 82 based on the pressure detected by the aforementioned load detector 91. Whether or not an arm crowding operation is being performed can be determined based on whether or not the pressure detected by the aforementioned operation detector 92 is substantially zero.

To be more specific, at the time of performing an arm crowding operation, if the pressure detected by the load detector 91 is lower than a predetermined value P1, the controller 9 feeds no electric current to the solenoid proportional valve 82. As a result, the bypass line 7 is blocked. On the other hand, if the pressure detected by the load detector 91 is higher than or equal to the predetermined value P1, the controller 9 feeds an electric current to the solenoid proportional valve 82. As a result, the bypass line 7 is opened.

Figure 3:
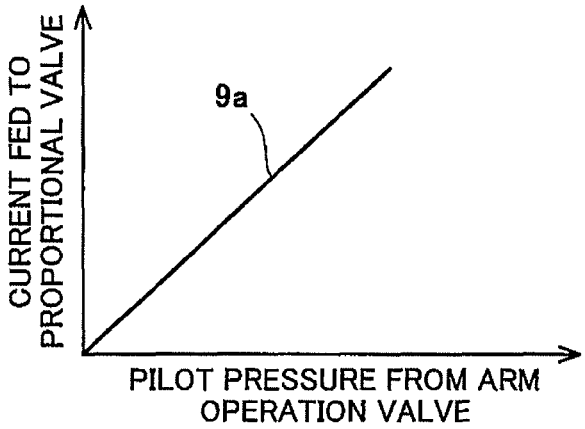
FIG. 3 is a graph showing a current/pilot pressure relation line in Embodiment 1.

In the present embodiment, if the pressure detected by the load detector 91 is higher than or equal to the predetermined value P1, then as shown in FIG. 3, the controller 9 feeds the solenoid proportional valve 82 with an electric current proportional to the pilot pressure detected by the operation detector 92. That is, a current/pilot pressure relation line 9*a* stored in the controller 9 in advance is a straight line with a constant slope. Accordingly, the position adjusting valve 81 opens the bypass line 7 such that the opening area of the bypass line 7 is substantially proportional to an operating amount of the arm operation valve 60.

As described above, in the drive system 1A of the present embodiment, at the time of expanding the arm cylinder 25 (i.e., at the time of performing an arm crowding operation), the bypass line 7 is blocked if the head-side pressure of the arm cylinder 25 is low (e.g., a case where the arm 13 is moved in the air). Accordingly, by setting the opening areas of the arm first control valve 61 and the arm second control valve 62 for returning the hydraulic oil to the tank at the time of expanding the cylinder to be small, the amount of hydraulic oil returning to the tank can be reduced, and thereby the rod-side back pressure of the arm cylinder 25 can be kept sufficiently high. This makes it possible to prevent cavitation from occurring at the head side of the arm cylinder 25 until the center of gravity of the arm 13 reaches directly below a swinging center 13*a* (see FIG. 2), and also prevent temporary stopping of the swinging of the arm 13 after the center of gravity of the arm 13 has reached directly below the swinging center 13*a*.

On the other hand, if the head-side pressure of the arm cylinder 25 is high (e.g., when excavation is being performed), the bypass line 7 is opened. Accordingly, even though the opening areas of the arm first control valve 61 and the arm second control valve 62 for returning the hydraulic oil to the tank at the time of expanding the cylinder are set to be small, large part of the hydraulic oil at the rod side of the arm cylinder 25 returns to the tank through the bypass line 7 at the time of expanding the arm cylinder 25. As a result, the discharge pressures of the first and second hydraulic pumps 21 and 22 will not increase more than necessary, which makes it possible to suppress wasteful energy consumption.

In the present embodiment, the controller 9 feeds the solenoid proportional valve 82 with an electric current proportional to the pilot pressure detected by the operation detector 92. This makes it possible to properly control the opening area of the position adjusting valve 81 in accordance with an operating amount of the arm operation valve 60.

In addition, in the present embodiment, since the position adjusting valve 81 is disposed on the first bleed line 31, the position adjusting valve 81 can be incorporated into a multi control valve unit together with the arm first control valve 61 and the other control valves disposed on the first bleed line 31.

<Variations>

The arm second control valve 62 is not an essential component. The drive system 1A may only include the arm first control valve 61 as a control valve for the arm cylinder 25. The same is true of Embodiments 2 to 4, which will be described below.

Figure 4:
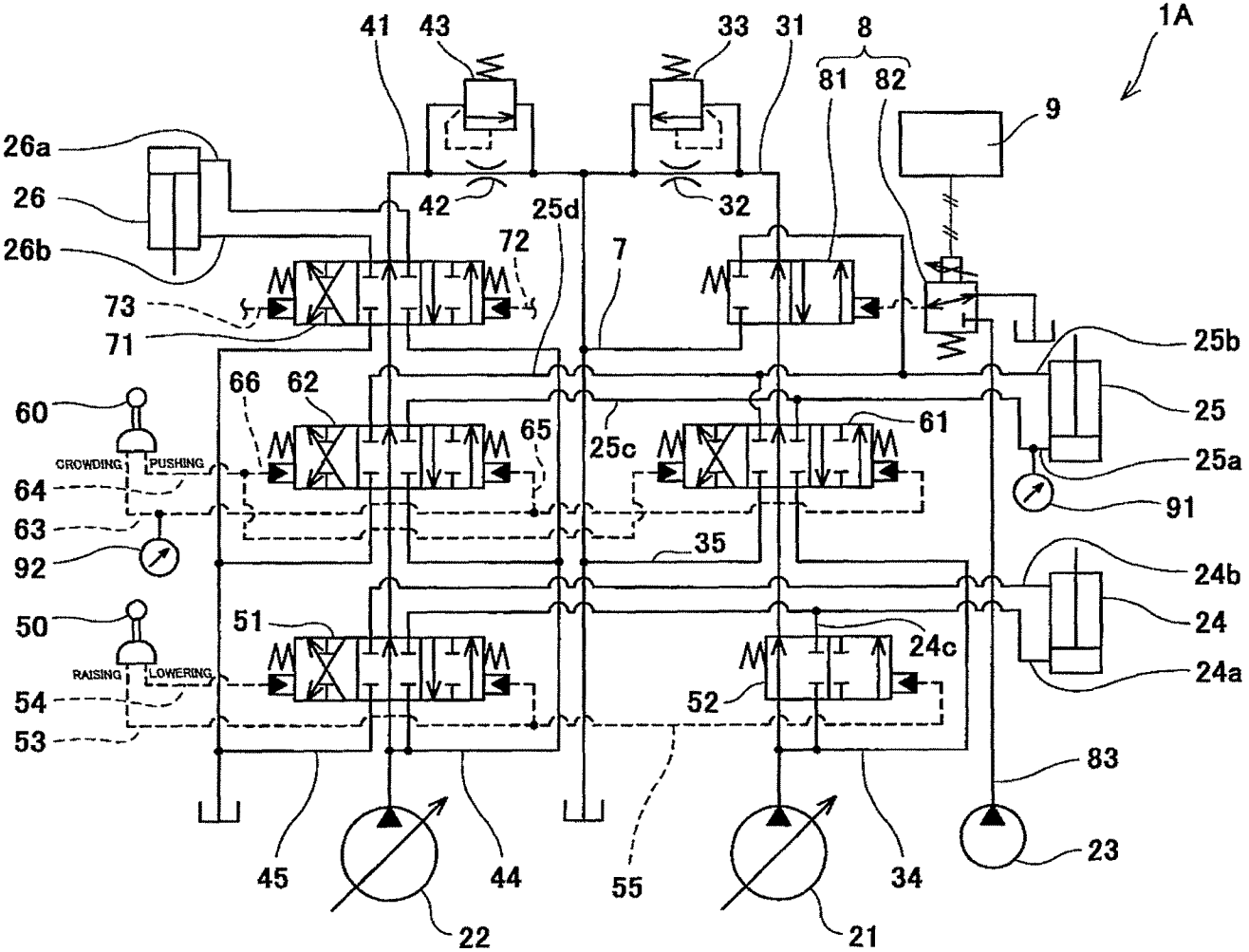
FIG. 4 is a hydraulic circuit diagram of one variation of Embodiment 1.

It is not essential that the load detector 91 be provided on the first bleed line 31. Alternatively, as shown in FIG. 4, the load detector 91 may be provided on the arm crowding supply line 25*a* so as to detect the pressure of the hydraulic oil supplied to the arm cylinder 25 through the arm crowding supply line 25*a*.

Embodiment 2

Figure 5:
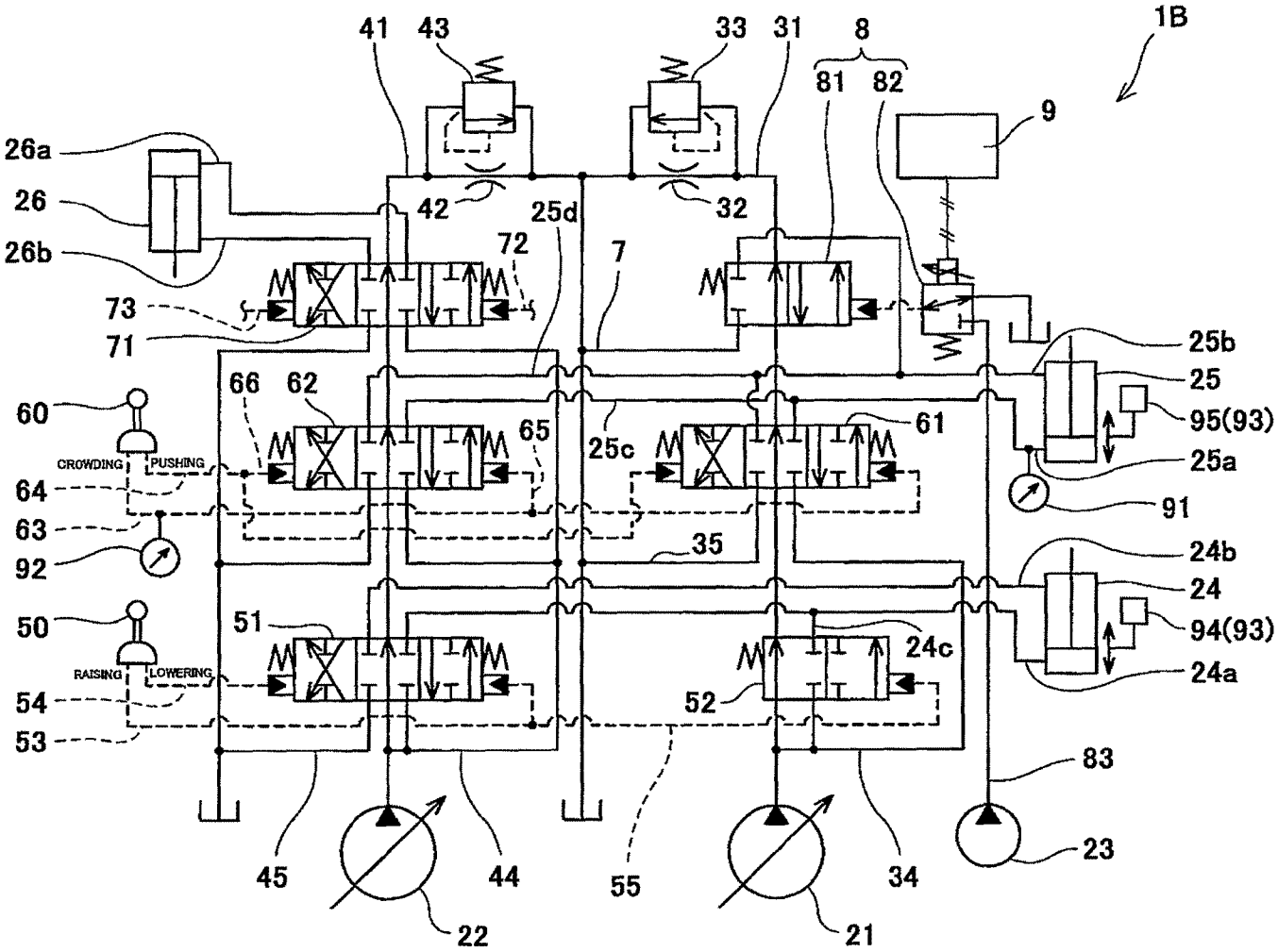
FIG. 5 is a hydraulic circuit diagram of a hydraulic excavator drive system according to Embodiment 2 of the present invention.

Next, a hydraulic excavator drive system 1B according to Embodiment 2 of the present invention is described with reference to FIG. 5. It should be noted that, in the present embodiment and the following Embodiments 3 and 4, the same components as those described in Embodiment 1 are denoted by the same reference signs as those used in Embodiment 1, and repeating the same descriptions is avoided.

In the present embodiment, similar to one variation (FIG. 4) of Embodiment 1, the load detector 91 is provided on the arm crowding supply line 25*a*. However, as an alternative, the load detector 91 may be of course provided on the first bleed line 31 similar to Embodiment 1 (FIG. 1). The same is true of Embodiments 3 and 4 described below.

In the present embodiment, the drive system 1B includes a position detector 93 for detecting the position of the arm 13. In the present embodiment, the position detector 93 is constituted by a stroke sensor 94 provided on the boom cylinder 24 and a stroke sensor 95 provided on the arm cylinder 25. Alternatively, for example, an inclination sensor provided on the arm 13 may be used as a position detector 93. Further alternatively, the position detector 93 may be constituted by two angle sensors that are an angle sensor detecting the raising/lowering angle of the boom 12 and an angle sensor detecting the angle formed between the boom 12 and the arm 13.

In Embodiment 2, control performed by the controller 9 is the same as the control described in Embodiment 1 except when an arm crowding operation is performed. At the time of performing an arm crowding operation, the controller 9 first determines, based on a detection result from the position detector 93, whether the center of gravity of the arm 13 is in a distant region A, which is a region more distant from the operator cab (a part of the turning unit 11) than a vertical line L passing through the swinging center 13*a*, or in an adjacent region B, which is a region closer to the operator cab than the vertical line L passing through the swinging center 13*a* (see FIG. 2). If the controller 9 determines that the center of gravity of the arm 13 is in the distant region A, then similar to Embodiment 1, the controller 9 controls the restrictor 8 such that the restrictor 8 blocks or opens the bypass line 7 in accordance with the pressure detected by the load detector 91.

On the other hand, if the controller 9 determines that the center of gravity of the arm 13 is in the adjacent region B, the controller 9 controls the restrictor 8 such that the restrictor 8 opens the bypass line 7 regardless of the pressure detected by the load detector 91. For example, if the controller 9 determines that the center of gravity of the arm 13 is in the adjacent region B, then similar to a case where the center of gravity of the arm 13 is in the distant region A, the controller 9 feeds the solenoid proportional valve 82 with an electric current proportional to the pilot pressure detected by the operation detector 92. Alternatively, the controller 9 may feed the solenoid proportional valve 82 with such an electric current as to cause the position adjusting valve 81 to fully open.

In the present embodiment, at the time of performing an arm crowding operation, if the center of gravity of the arm 13 is in the adjacent region B, i.e., in a case where the weight of the arm 13 is exerted on the arm 13 itself in a direction reverse to the swinging direction, the bypass line 7 is opened. That is, blocking of the bypass line 7 at the time of performing an arm crowding operation can be limitedly performed only in a case where the weight of the arm 13 is exerted on the arm 13 itself in the swinging direction. This makes it possible to make the most of the bypass line 7.

Embodiment 3

Figure 6:
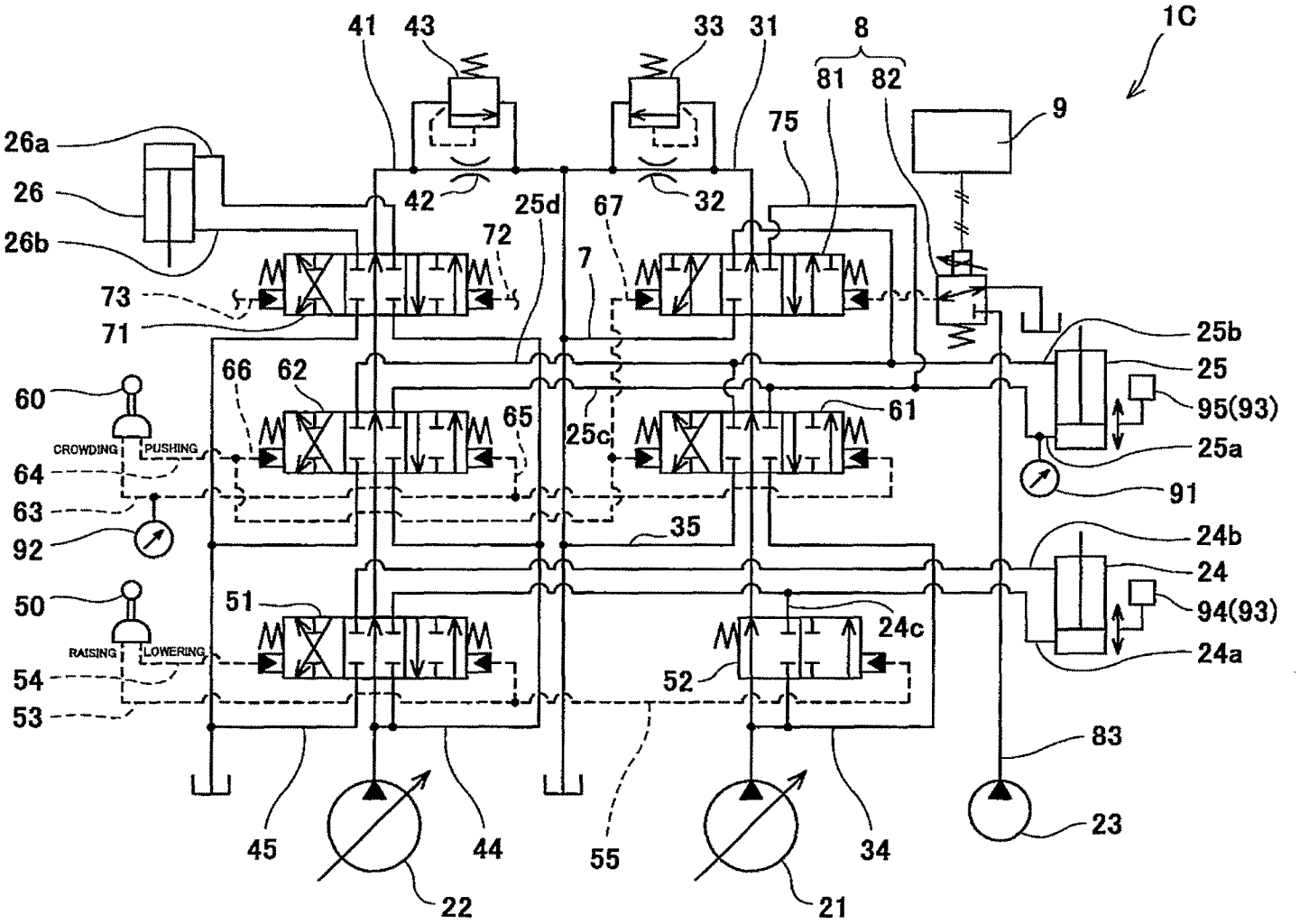
FIG. 6 is a hydraulic circuit diagram of a hydraulic excavator drive system according to Embodiment 3 of the present invention.

Next, a hydraulic excavator drive system 1C according to Embodiment 3 of the present invention is described with reference to FIG. 6. The drive system 1C according to the present embodiment is a result of modifying the hydraulic drive system 1B of Embodiment 2. It should be noted that the drive system 1C need not include the position detector 93 described in Embodiment 2.

In Embodiments 1 and 2, the position adjusting valve 81 of the restrictor 8 is a two-position valve. However, in the present embodiment, the position adjusting valve 81 is a three-position valve. The position adjusting valve 81 moves between a neutral position and a first position (a right-side position in FIG. 6) in order to realize the functions described in Embodiments 1 and 2. That is, the position adjusting valve 81 blocks the bypass line 7 when the position adjusting valve 81 is at the neutral position, and opens the bypass line 7 when the position adjusting valve 81 has moved to the first position. In other words, at the time of performing an arm crowding operation, the position adjusting valve 81 moves to the first position when the conditions described in Embodiments 1 and 2 are satisfied. It should be noted that the position adjusting valve 81 blocks the bypass line 7 also when the position adjusting valve 81 has moved to a second position (a left-side position in FIG. 6).

At the time of performing an arm-pushing operation (i.e., when the hydraulic oil is supplied to the arm cylinder 25 through the arm pushing supply line 25*b*), the position adjusting valve 81 always moves from the neutral position to the second position or to a position between the neutral position and the second position. The position adjusting valve 81 is connected to the arm crowding supply line 25*a* by a relay line 75. When positioned at the neutral position, the position adjusting valve 81 blocks the relay line 75. When moving to the second position, the position adjusting valve 81 brings the relay line 75 into communication with a part of the bypass line 7, the part being downstream of the position adjusting valve 81. In other words, the relay line 75 comes into communication with the tank through the bypass line 7 when the position adjusting valve 81 moves to the second position.

The position adjusting valve 81 includes a pilot port for moving the position adjusting valve 81 to the second position. The pilot port is connected to the arm pushing pilot line 64 by a pilot line 67. That is, at the time of performing an arm-pushing operation, the position adjusting valve 81 brings the relay line 75 into communication with the tank with an opening area corresponding to the pilot pressure outputted from the arm operation valve 60.

According to the present embodiment, at the time of performing an arm-pushing operation, part of the hydraulic oil flowing out of the head side of the arm cylinder 25 can be returned to the tank without flowing through the arm first control valve 61 and the arm second control valve 62. That is, the back pressure at the time of contracting the arm cylinder 25 can be successfully reduced by effectively utilizing the position adjusting valve 81 and the bypass line 7.

Embodiment 4

Figure 7:
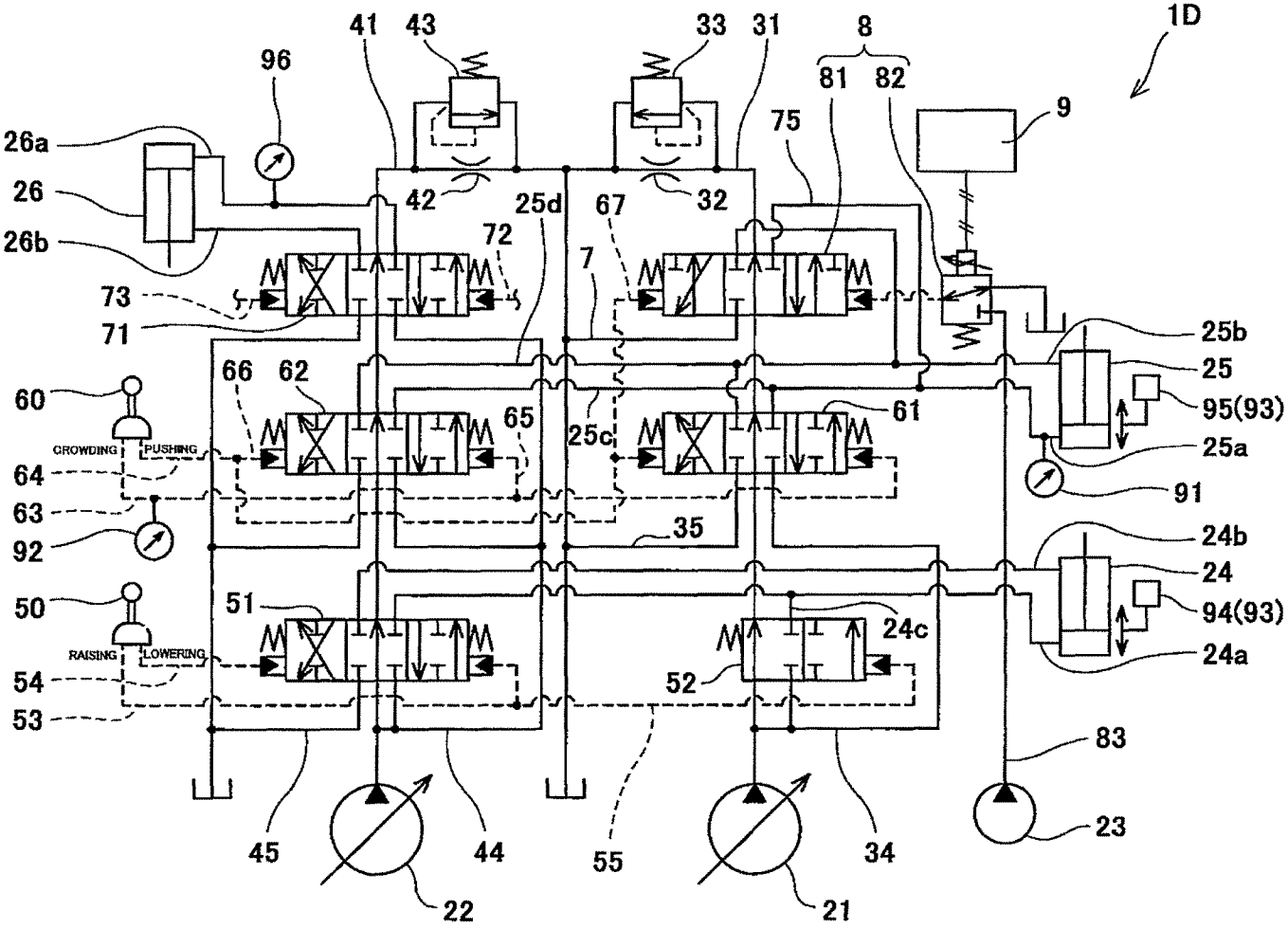
FIG. 7 is a hydraulic circuit diagram of a hydraulic excavator drive system according to Embodiment 4 of the present invention.

Next, a hydraulic excavator drive system 1D according to Embodiment 4 of the present invention is described with reference to FIG. 7. The drive system 1D according to the present embodiment is a result of modifying the hydraulic drive system 1C of Embodiment 3. It should be noted that, unlike Embodiment 3, the position adjusting valve 81 of the restrictor 8 used in the drive system 1D need not be a three-position valve, but may be a two-position valve as described in Embodiment 1.

In the present embodiment, an excavation detector 96 for detecting the head-side pressure of the bucket cylinder 26 is provided on the bucket-in supply line 26*a*. The controller 9 performs control similar to that described in Embodiment 2. However, if it is determined that the center of gravity of the arm 13 is in the adjacent region B (see FIG. 2), the controller 9 varies the electric current fed to the solenoid proportional valve 82 based on the pressure detected by the excavation detector 96.

Figure 8:
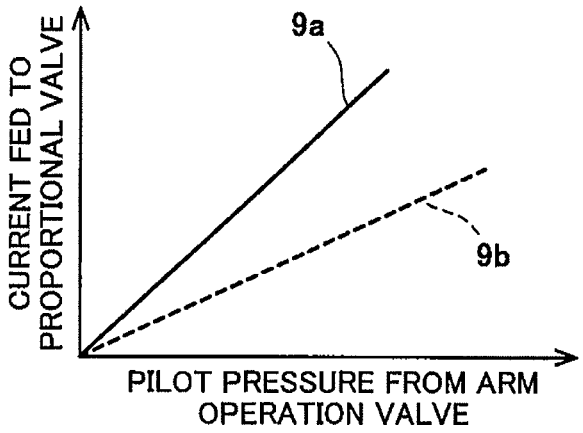
FIG. 8 is a graph showing a current/pilot pressure relation line in Embodiment 4.

To be more specific, if it is determined that the center of gravity of the arm 13 is in the distant region A (see FIG. 2) and that the pressure detected by the load detector 91 is higher than or equal to the predetermined value P1, then as shown in FIG. 8, the controller 9 feeds the solenoid proportional valve 82 with an electric current that is set based on the constant-slope current/pilot pressure relation line 9*a* described in Embodiment 1.

In the present embodiment, not only the current/pilot pressure relation line 9*a*, but also a current/pilot pressure relation line 9*b* whose slope is less steep than that of the current/pilot pressure relation line 9*a*, is stored in the controller 9 in advance.

If it is determined that the center of gravity of the arm 13 is in the adjacent region B and that the pressure detected by the excavation detector 96 is higher than or equal to a threshold P2, the controller 9 feeds the solenoid proportional valve 82 with a relatively large electric current that is set based on the current/pilot pressure relation line 9*a*. That is, if the pressure detected by the excavation detector 96 is high (e.g., at the time of performing excavation), then in the adjacent region B, the bypass line 7 is opened with a large opening area. On the other hand, if the pressure detected by the excavation detector 96 is lower than the threshold P2, the controller 9 feeds the solenoid proportional valve 82 with a relatively small electric current that is set based on the current/pilot pressure relation line 9*b*. That is, if the pressure detected by the excavation detector 96 is low (e.g., at the time no loading by the excavator), then in the adjacent region B, the bypass line 7 is opened with a small opening area.

According to the present embodiment, in a case where it is determined that the center of gravity of the arm 13 is in the adjacent region B, if the bucket is not excavating, the arm can be moved at a moderate speed, i.e., not too fast and not too slow. In addition, the discharge pressures of the hydraulic pumps will not increase more than necessary. This makes it possible to suppress wasteful energy consumption.

Other Embodiments

The present invention is applicable not only to meter-out control at the time of expanding the arm cylinder 25, but also to meter-out control at the time of expanding the bucket cylinder 26. In this case, the moving part of the present invention is the bucket 14; the head-side supply/discharge line of the present invention corresponds to the bucket-in supply line 26*a*; and the rod-side supply/discharge line of the present invention corresponds to the bucket-out supply line 26*b*. The bypass line 7 branches off from the bucket-out supply line 26*b*. In the case where the moving part of the present invention is the bucket 14, configurations (1) to (4) described below can be adopted, for example.

(1) Similar to Embodiment 1 and its variation, a load detector for detecting the pressure of the hydraulic oil discharged from the second hydraulic pump 22 or for detecting the pressure of the hydraulic oil supplied to the bucket cylinder 26 through the bucket-in supply line 26*a* may be provided. The restrictor 8, which blocks and opens the bypass line 7, may be controlled by the controller 9 such that, at the time of performing a bucket-in operation (i.e., when the hydraulic oil is supplied to the bucket cylinder 26 through the bucket-in supply line 26*a*), the restrictor 8 blocks the bypass line 7 if the pressure detected by the load detector is lower than a predetermined value P3, and opens the bypass line 7 if the pressure detected by the load detector is higher than or equal to the predetermined value P3.

According to the above configuration, at the time of expanding the bucket cylinder 26 (at the time of performing a bucket-in operation), the bypass line 7 is blocked if the head-side pressure of the bucket cylinder 26 is low (e.g., a case where the bucket 14 (see FIG. 2) is moved in the air). Accordingly, by setting the opening area of the bucket control valve 71 for returning the hydraulic oil to the tank at the time of expanding the cylinder to be small, the amount of hydraulic oil returning to the tank can be reduced, and thereby the rod-side back pressure of the bucket cylinder 26 can be kept sufficiently high. This makes it possible to prevent cavitation from occurring at the head side of the bucket cylinder 26 until the center of gravity of the bucket 14 reaches directly below a swinging center 14*a* (see FIG. 2), and also prevent temporary stopping of the swinging of the bucket 14 after the center of gravity of the bucket 14 has reached directly below the swinging center 14*a*.

On the other hand, if the head-side pressure of the bucket cylinder 26 is high (e.g., when excavation is being performed), the bypass line 7 is opened. Accordingly, even though the opening area of the bucket control valve 71 for returning the hydraulic oil to the tank at the time of expanding the cylinder is set to be small, large part of the hydraulic oil at the rod side of the bucket cylinder 26 returns to the tank through the bypass line 7 at the time of expanding the bucket cylinder 26. As a result, the discharge pressure of the second hydraulic pump 22 will not increase more than necessary, which makes it possible to suppress wasteful energy consumption.

(2) Similar to Embodiment 1, the restrictor 8 may be constituted by the position adjusting valve 81 and the solenoid proportional valve 82 provided on the bypass line 7. The controller 9 may feed the solenoid proportional valve 82 with an electric current proportional to the pilot pressure that is outputted from the bucket operation valve (not shown) to the bucket control valve 71 if the pressure detected by the load detector is higher than or equal to the predetermined value P3. The position adjusting valve 81 may be a four-port valve that is disposed on the second bleed line 41, or may be a two-port valve that is not disposed on the second bleed line 41.

(3) Similar to Embodiment 2, a position detector for detecting the position of the bucket 14 may be provided. The position detector may be constituted by the stroke sensor 94 provided on the boom cylinder 24, the stroke sensor 95 provided on the arm cylinder 25, and a stroke sensor (not shown) provided on the bucket cylinder 26. Alternatively, for example, the position detector may be an inclination sensor provided on the bucket, or may be constituted by three angle sensors that are an angle sensor detecting the raising/lowering angle of the boom 12, an angle sensor detecting the angle between the boom 12 and the arm 13, and an angle sensor detecting the angle between the arm 13 and the bucket 14.

In the case where the position detector is provided, the controller 9 may determine, based on a detection result from the position detector, whether the center of gravity of the bucket 14 is in a distant region that is a region more distant from the operator cab than a vertical line passing through the swinging center 14*a*, or in an adjacent region that is a region closer to the operator cab than the vertical line passing through the swinging center 14*a*. If the controller 9 determines that the center of gravity of the bucket is in the distant region, the controller 9 may control the restrictor 8 such that the restrictor 8 blocks or opens the bypass line 7 in accordance with the pressure detected by the load detector. On the other hand, if the controller 9 determines that the center of gravity of the bucket 14 is in the adjacent region, the controller 9 may control the restrictor 8 such that the restrictor 8 opens the bypass line 7 regardless of the pressure detected by the load detector.

(4) Similar to Embodiment 3, the position adjusting valve 81 may be connected to the bucket-in supply line 26*a* by the relay line 75, and the relay line 75 may be brought into communication with the tank through the bypass line 7 when the hydraulic oil is supplied to the bucket cylinder 26 through the bucket-out supply line 26*b*. According to this configuration, at the time of performing a bucket-out operation, part of the hydraulic oil flowing out of the head side of the bucket cylinder 26 can be returned to the tank without flowing through the bucket control valve 71.

Regardless of whether the present invention is applied to meter-out control at the time of expanding the arm cylinder 25 or meter-out control at the time of expanding the bucket cylinder 26, it is not essential that the restrictor 8 be constituted by the position adjusting valve 81 and the solenoid proportional valve 82. The restrictor 8 may be a single solenoid on-off valve, or may be a single solenoid throttle valve.

The method of controlling the discharge flow rate of each of the first and second hydraulic pumps 21 and 22 need not be a negative control method, but may be a positive control method. Moreover, the method of controlling the discharge flow rate of each of the first and second hydraulic pumps 21 and 22 may be a load-sensing method.

INDUSTRIAL APPLICABILITY

The present invention is useful not only for self-propelled hydraulic excavators but also for various types of hydraulic excavators.

REFERENCE SIGNS LIST

1A to 1C hydraulic excavator drive system
13 arm
13*a* swinging center
14 bucket
14*a* swinging center
21, 22 hydraulic pump
25 arm cylinder
25*a* arm crowding supply line (head-side supply/discharge line)
25*b* arm pushing supply line (rod-side supply/discharge line)
26 bucket cylinder
26*a* bucket-in supply line (head-side supply/discharge line)
26*b* bucket-out supply line (rod-side supply/discharge line)
31, 41 bleed line
60 arm operation valve
61 arm first control valve
62 arm second control valve
7 bypass line
71 bucket control valve
75 relay line
8 restrictor
81 position adjusting valve
82 solenoid proportional valve
9 controller
91 load detector
92 operation detector
93 position detector
94, 95 stroke sensor
96 excavation detector

The invention claimed is:

1. A hydraulic excavator drive system comprising:
a cylinder that drives a moving part that is an arm or a bucket;
a control valve connected to the cylinder by a head-side supply/discharge line and a rod-side supply/discharge line;
a hydraulic pump that supplies hydraulic oil to the cylinder via the control valve;
a load detector that detects a pressure of the hydraulic oil discharged from the hydraulic pump or a pressure of the hydraulic oil supplied to the cylinder through the head-side supply/discharge line;
a bypass line that branches off from the rod-side supply/discharge line and connects to a tank;
a restrictor that blocks and opens the bypass line;
a controller that controls the restrictor such that, when the hydraulic oil is supplied to the cylinder through the head-side supply/discharge line, the restrictor blocks the bypass line if the pressure detected by the load detector is lower than a predetermined value, and opens the bypass line if the pressure detected by the load detector is higher than or equal to the predetermined value; and
a position detector that detects a position of the moving part, wherein
the controller:
controls the restrictor such that the restrictor blocks or opens the bypass line in accordance with the pressure detected by the load detector if the controller determines, based on a detection result from the position detector, that a center of gravity of the moving part is distant from an operator cab than a vertical line that passes through a swinging center of the moving part; and
controls the restrictor such that the restrictor opens the bypass line regardless of the pressure detected by the load detector if the controller determines, based on the detection result from the position detector, that the center of gravity of the moving part is closer to the operator cab than the vertical line that passes through the swinging center of the moving part.

2. The hydraulic excavator drive system according to claim 1, wherein
the restrictor includes:
a position adjusting valve that is provided on the bypass line and that increases its opening area in accordance with an increase in a pilot pressure; and
a solenoid proportional valve that outputs the pilot pressure to the position adjusting valve.

3. The hydraulic excavator drive system according to claim 2, further comprising:
an operation valve that outputs a pilot pressure to the control valve; and
an operation detector that detects the pilot pressure outputted from the operation valve, wherein
the controller feeds the solenoid proportional valve with an electric current proportional to the pilot pressure detected by the operation detector if the pressure detected by the load detector is higher than or equal to the predetermined value.

4. The hydraulic excavator drive system according to claim 3, wherein
the moving part is an arm, and the cylinder is an arm cylinder, the hydraulic excavator drive system further includes an excavation detector that detects a head-side pressure of a bucket cylinder, and in a case where the controller determines, based on a detection result from the position detector, that the center of gravity of the arm is closer to the operator cab than the vertical line that passes through the swinging center of the arm, if the pressure detected by the excavation detector is higher than or equal to a threshold, the controller feeds the solenoid proportional valve with an electric current that is set based on a current/pilot pressure relation line that is the same as a current/pilot pressure relation line based on which the electric current fed to the solenoid proportional valve when the pressure detected by the load detector is higher than or equal to the predetermined value is set, and if the pressure detected by the excavation detector is lower than the threshold, the controller feeds the solenoid proportional valve with an electric current that is set based on a current/pilot pressure relation line whose slope is less than that of the current/pilot pressure relation line based on which the electric current fed to the solenoid proportional valve when the pressure detected by the load detector is higher than or equal to the predetermined value is set.

5. The hydraulic excavator drive system according to claim 2, wherein the position adjusting valve is connected to the head-side supply/discharge line by a relay line, and is configured to bring the relay line into communication with the tank through the bypass line when the hydraulic oil is supplied to the cylinder through the rod-side supply/discharge line.

6. The hydraulic excavator drive system according to claim 2, wherein the position adjusting valve is disposed on a bleed line extending from the hydraulic pump.

* * * * *